US006768059B1

(12) United States Patent
Lefavour et al.

(10) Patent No.: US 6,768,059 B1
(45) Date of Patent: Jul. 27, 2004

(54) OFFSET AND POLARIZED CRIMPING DIE AND DIE HOLDER

(75) Inventors: John D. Lefavour, Litchfield, NH (US); Christopher G. Chadbourne, Nashua, NH (US); Armand T. Montminy, Manchester, NH (US); Clayton W. Mack, Boscawen, NH (US); Gordon L. Steltzer, Goffstown, NH (US); Gary W. DiTroia, Brookline, NH (US)

(73) Assignee: FCI Americas Technology, Inc., Reno, NV (US)

( * ) Notice: Subject to any disclaimer, the term of this patent is extended or adjusted under 35 U.S.C. 154(b) by 32 days.

(21) Appl. No.: 10/241,226

(22) Filed: Sep. 10, 2002

(51) Int. Cl.[7] ..... H01R 4/00
(52) U.S. Cl. ..... 174/84 C
(58) Field of Search ..... 174/84 C; 72/402, 72/416, 453.15, 453.16, 412, 470; 29/237; 439/877; 403/275, 391

(56) References Cited

U.S. PATENT DOCUMENTS 4,942,757 A * 7/1990 Pecora ..... 72/453.16
5,062,290 A * 11/1991 Hoover ..... 72/416
5,200,576 A * 4/1993 Schrader et al. ..... 174/94 R
5,421,186 A * 6/1995 Lefavour ..... 72/416
5,635,676 A * 6/1997 Piriz ..... 174/84 C
5,898,131 A * 4/1999 Chadbourne et al. ..... 174/84 C
6,227,030 B1 * 5/2001 Lefavour et al. ..... 72/416
6,324,884 B1 * 12/2001 Barjesteh et al. ..... 72/402
6,452,103 B1 * 9/2002 Piriz et al. ..... 174/84 C
6,486,403 B1 * 11/2002 Connor ..... 174/84 C
6,538,204 B2 * 3/2003 Connor ..... 174/84 R
6,552,271 B2 * 4/2003 Connor et al. ..... 174/84 R

* cited by examiner

*Primary Examiner*—William H. Mayo, III
(74) *Attorney, Agent, or Firm*—Harrington & Smith, LLP

(57) ABSTRACT

An electrical connector crimping tool die set for crimping an asymmetrical electrical connector onto at least one electrical conductor. The die set includes a first crimping die adapted to be removably mounted to a crimping tool; and a second crimping die adapted to be removably mounted to a movable ram of the crimping tool opposite the first die. The second die includes a generally convex shaped rear side and a generally concave shaped front side. The front side forms a crimping groove with a center axis that is offset from a center axis of the generally convex shaped rear side. The asymmetrical electrical connector can be crimped between the first and second dies at an angle to a center axis of movement of the ram to provide a direction of crimp force substantially along or parallel to the center axis of movement of the ram.

17 Claims, 6 Drawing Sheets

OFFSET AND POLARIZED CRIMPING DIE AND DIE HOLDER

BACKGROUND OF THE INVENTION

1. Field of the Invention

The present invention relates to compression tools and, more particularly, to compression tools for asymmetric shaped electrical connectors.

2. Brief Description of Prior Developments

U.S. Pat. No. 5,898,131 describes a hydraulic compression tool having crimping dies with angled connector receiving areas for compressing twisted H-shaped electrical connectors.

Certain compression electrical connectors, primarily those used in grounding, telecommunications, and overhead applications, are fabricated in non-symmetrical shapes in order to provide the best combination of electrical integrity, mechanical strength, and ease of installation for the user. When crimped with standard, "mirror image" or identically shaped upper and lower dies, these connectors project non-axial forces on the dies and the crimping tools used to install them. The non-symmetrical nature of the connector means that one side of the connector is resisting the process of deformation more than the other side.

In some prior art connector crimping tools, a "T" slot engagement was provided with the ram as a keying system to prevent the ram from canting or rotating when attempting to compress an asymmetrical connector. The T slot helped to prevent the ram from sticking. However, the T slot engagement could wear over time. Thus, over time, the ram could stick when compressing an asymmetrical connector.

In addition to this problem, the application of non-axial forces on many existing and newer hydraulic crimp tool designs result in the inability of the crimp tool ram to retract, and/or can cause damage to the crimping heads either immediately or over long-term use. Damage may render the tool inoperable and permanently damaged, thus requiring a new tool to be purchased in its' place. This places considerable expense and frustration on the user or installer. There is a desire to allow asymmetrical electrical connectors to be crimped without the problems noted above.

SUMMARY OF THE INVENTION

In accordance with one aspect of the present invention, an electrical connector crimping tool die set is provided for crimping an asymmetrical electrical connector onto at least one electrical conductor. The die set includes a first crimping die adapted to be removably mounted to a crimping tool; and a second crimping die adapted to be removably mounted to a movable ram of the crimping tool opposite the first die. The second die comprises a generally convex shaped rear side and a generally concave shaped front side. The front side forms a crimping groove with a center axis that is offset from a center axis of the generally convex shaped rear side. The asymmetrical electrical connector can be crimped between the first and second dies at an angle to a center axis of movement of the ram to provide a direction of crimp force substantially along or parallel to the center axis of movement of the ram.

In accordance with another aspect of the present invention, an electrical connector crimping tool is provided comprising a frame; a drive system connected to the frame, the drive system comprising a movable ram; and connector crimping dies connected to the frame and the ram. The crimping dies comprise opposing crimp grooves with a centerline between centers of the crimp grooves which is angled relative to a central axis of movement of the ram on the frame.

In accordance with one method of the present invention, a method of crimping an asymmetrical electrical connector is provided comprising steps of connecting crimping dies to an electrical connector crimping tool; and moving a ram of the crimping tool to compress the asymmetrical electrical connector between the crimping dies. One of the crimping dies connected to the ram has a crimping groove which is offset relative to an opposing crimping groove of another one of the dies connected to a frame of the crimping tool such that the opposing crimping grooves have a centerline therebetween that is angled relative to a central axis of movement of the ram on the frame such that the asymmetrical electrical connector is crimped with a direction of crimp force substantially along or parallel to the central axis of movement of the ram.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
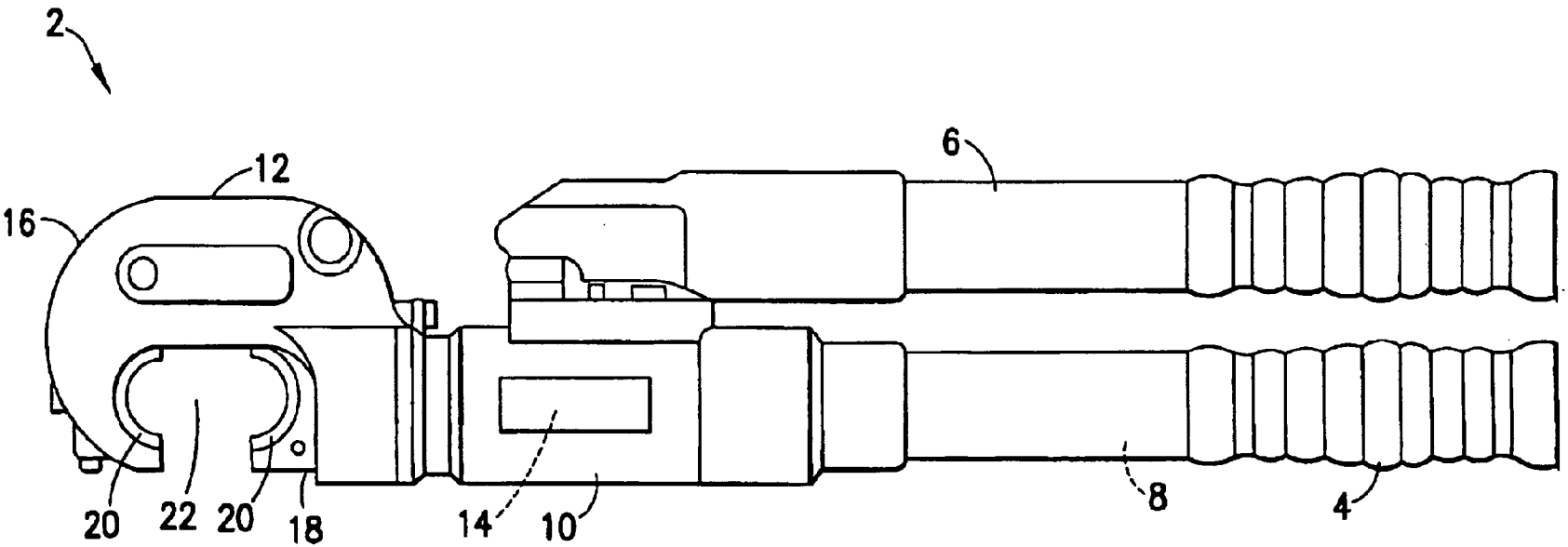
FIG. 1 PRIOR ART
FIG. 1 is an elevational side view of a conventional hydraulic hand operated connector compression tool.

Referring to FIG. 1, there shown an elevational side view of a conventional hydraulic tool 2 used to compress electrical compression connectors onto electrical conductors. One such tool is sold by FCI USA Inc. under the part designation Y750. However, features of the present invention could be incorporated into any suitable type of compression tool. For example, another such tool is sold by FCI USA Inc. under the part designation Y46.

The tool 2 shown in FIG. 1 generally comprises a first handle 4 having a fluid reservoir 8 therein, a second handle 6, a body 10 and a compression head 12. A hydraulic pump 14 is located inside the body 10. The compression head 12 generally comprises a frame 16 and a movable ram 18. The ram 18 is moved forward on the frame 16 by hydraulic pressure from hydraulic fluid delivered from the pump 14. The frame 16 and the ram 18 are each adapted to removably receive a crimping die 20. A connector receiving space 22 is formed between the two crimping dies 20. When the ram is advanced to move the two dies 20 towards each other, a connector located between the two dies can be compressed or crimped onto electrical conductors.

Figure 2:
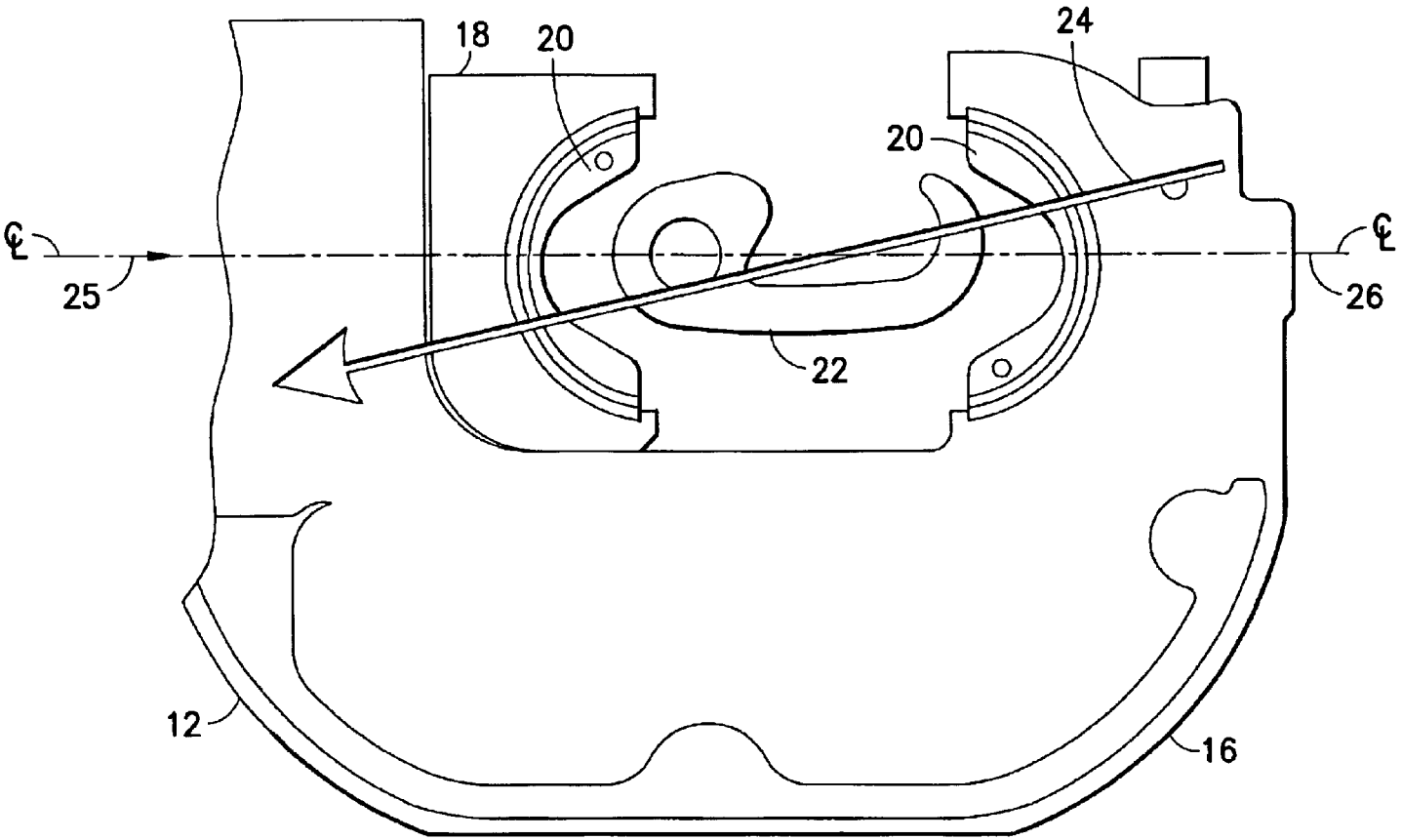
FIG.2 PRIOR ART
FIG. 2 is an enlarged, partial side view of the working head of the tool shown in FIG. 1 with an asymmetrical electrical connector to be crimped located between the crimping dies.

Referring also to FIG. 2, there is shown an enlarged side view of the compression head 12 with an electrical compression connector 22 (which is intended to be crimped) shown located between the two dies 20. As can be seen, the connector 22 comprises a general asymmetric or non-symmetrical shape. Connectors such as this are primarily used in grounding, telecommunications and overhead applications. The non-symmetrical shape of the connector provides the best combination of electrical integrity, mechanical strength, and ease of installation for the user. The non-symmetrical nature of the connector 22 means that one side of the connector 22 resists the process of deformation more than the other side.

When crimped with the standard, identically shaped upper and lower dies 20, compression of the non-symmetrical connector 22 projects a non-axial direction of crimp force 24 on the dies 20 and the crimping tool. This non-axial force 24 is angled relative to the centerline or central axis 26 of the direction of movement 25 of the ram 18 forward during crimping. This figure shows the standard prior art where the direction of crimp force 24 is not in line with the central axis 26. Because the connector has a tendency to buckle, this can force the ram, which forms the lower die holder, upward. This can potentially damage the tool.

As noted above in the background section, the application of non-axial forces on many existing and newer hydraulic crimp tool designs result in the inability of the crimp tool ram to retract, and/or can cause damage to the crimping heads either immediately or over long-term use. Damage may render the tool inoperable and permanently damaged, thus requiring a new tool to be purchased in its' place. This places considerable expense and frustration on the user or installer.

In order to mitigate these problems, a solution can be provided with the present invention whereby the crimping dies that are used for non-symmetrical connectors are not mirror images of each other. Instead, their crimp profiles are offset from one another such that the result is axial, or nearly axial, crimp forces on the dies and tools. This can aid greatly in proper retraction of the tool ram, extend the life of the tool, and at the same time maintain the standard crimp dimensions that have been documented as meeting the requirements for connector performance.

Figure 3:
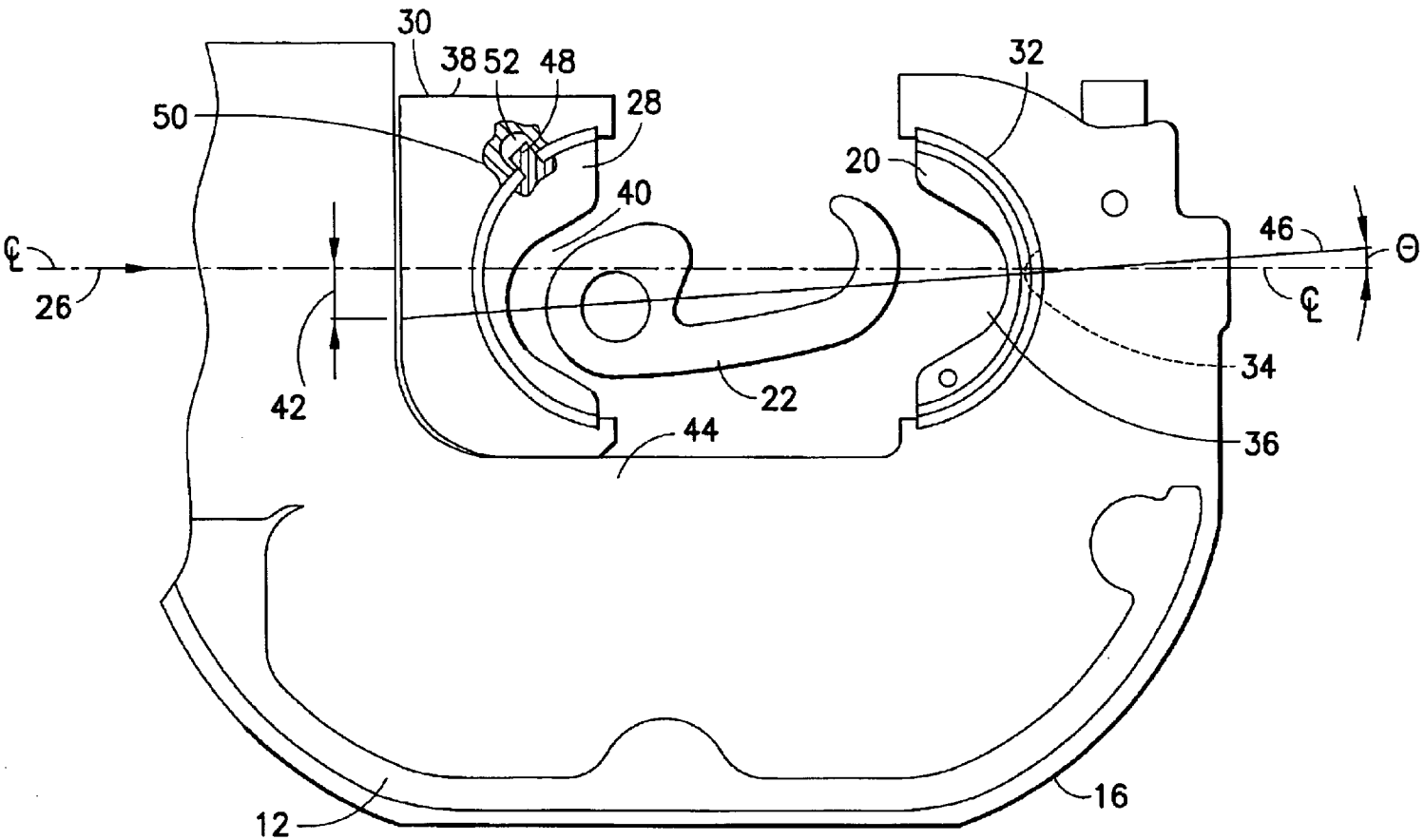
FIG. 3 is an enlarged, partial side view of the working head of a tool incorporating features of the present invention with the asymmetrical electrical connector located between the crimping dies.

Referring now to FIG. 3, the compression head 12 is shown with a die set which comprises a first crimping die 20 and a second crimping die 28. The compression head 12 is substantially similar to the compression head described with reference to FIGS. 1 and 2. However, in the embodiment shown, a modified die holder 38 of the ram 30 has been provided.

In the embodiment shown in FIG. 3, there is an upper die installed in the tool crimp head (sometimes referred to as the "fixed die"). This die 20 has a crimp groove 36 centrally located in the die, meaning that the axis of the crimp profile is central to the outer radius of the die and the radius of the fixed die holder 32 of the frame 16. This die 20 is preferably engaged by a spring loaded die button 34 that locks into a groove in the outer radius of the die. The location of the die button 34 for the fixed die is on an axis which is parallel to the center of the outer radius of the crimp die and the center of the crimp groove 36.

The second lower die 28 installed in the lower die holder 38 of the tool (sometimes referred to as the "movable die") has a crimp groove 40 which is offset 42 from the center of the outer radius of the die. The preferred offset 42 for the most common die that this invention relates to is about ⅛" from the center line of the die/ram axis. However, that value could vary without decreasing the effectiveness of the invention. This provides an angle of offset between the central axis 26 and the centerline 46 of the crimp die grooves 36, 40 of between about 2 degrees to about 8 degrees. In a preferred embodiment the angle is about 5 degrees The axial loading of the tool is achieved when the offset of the crimping groove is placed towards the closed end 44 of the crimp head; such that the center of the crimp groove 40 is under the centerline or axis 26 of the movable ram and fixed die holder.

In this configuration, as a crimp is made, the non-axial forces generated by the nonsymmetrical connector 22 tend to be negated by the configuration of the movable crimping die 28 that is offset from the centerline or axis of movement 26. The result is that a normally non-axial force (see force 24 in FIG. 2) becomes nearly axial; minimizing or eliminating unnecessary and damaging forces.

The present invention increases the working life of the compression tool because of the minimizing or elimination of the angling of force 24 shown in FIG. 2 by aligning the force into or closer towards direction 25 along the centerline 26. More of the force is directed into compressing the connector 22 rather than deflecting the front of the frame 16 outward. Thus, the present invention can provide more consistent connector crimping of asymmetric connectors than previously available.

The present invention can allow for the elimination of the prior art "T" slot sliding engagement or mounting between the ram and the frame/head. The present invention can reduce or virtually eliminate a moment on the ram from compression of an asymmetrical connector. The present invention can help to keep the asymmetrical connector in a same plane, such as a horizontal or level plane, during crimping. The present invention prevents canting or rotating of the ram during compression of the asymmetrical connector. This results in less wear on the ram and on the bearing which connects the ram with the frame/head of the tool.

In a test performed in crimping an asymmetrical connector with a tool that did not have the "T" slot, and without use of the present invention, the ram of the tool got stuck 2 out of 4 times. With the present invention, this problem of the ram sticking or getting jammed in the frame/head is virtually eliminated. The ram was kept on a straight path without the use of a "T" slot mounting which could wear out. In addition, the compression cycle of the tool was much smoother and encountered less resistance by the tool itself. This smoother operation could be physically heard by the operator. More power from the hydraulic pump went into the crimping of the connector than with prior tools.

In order to insure that the proper die is located in the proper die holder, as well as the profile of the offset die 28 being placed in the correct orientation with respect to the crimp head, 'polarizing' or 'keying' of the offset die with the lower movable die holder is preferably provided such that the second die 28 can only be located in the die holder 38 in one orientation. This can ensure that the user installs the dies in the proper orientation. Therefore, this can insure that the crimp is completed properly and with minimal non-axial loading. Even further, there are alternate embodiments of insuring that the dies are installed in the correct orientation and these will be described and illustrated below.

FIG. 3 illustrates one type of preferred embodiment of a 'polarized' or 'keyed' die and die holder. As seen in crosssectioned area 50, the lower movable die 28 is equipped with a pin or projection 48 that is installed into the underside of the die, and protrudes about ⅛" from the outer surface of the main body of the die. However, it could protrude more or less without harming intent. This pin 48 is ideally placed near the 'thick' cross-section of the die 28 near the open end of the crimp head where the most material cross-section exists. This would minimize stresses on the die 28 and die holder 38 during operation. Unlike a prior art die set which had a keying feature on lateral side legs of the dies, by providing the keying feature directly on the main body of the dies rather than lateral side legs, the keying projection is stronger and less likely to break over time.

The lower movable die holder 38 has an integral slot 52 which is placed in the position that allows the lower die to only be installed so that the offset crimp groove 40 is located towards the closed end 44 of the crimp head. The design is such that any other orientation of the die 28 cannot be fixably installed in either the upper (fixed) or lower (moveable) die holders. This prevents the dies 20, 28 from being installed incorrectly, and insures that the resultant crimps made with this die set are made with the dies in the proper orientation to minimize or eliminate non-axial loading.

Figure 4:
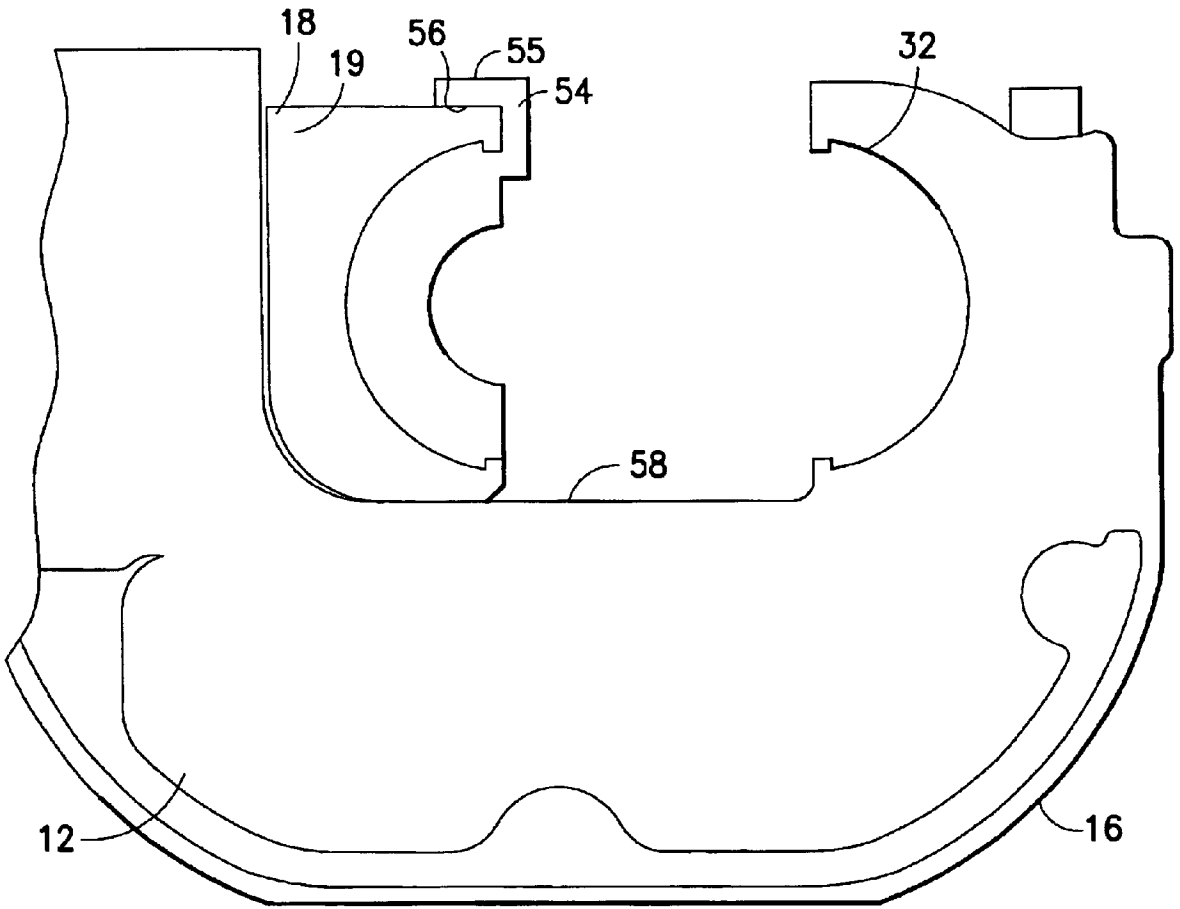
FIG. 4 is an enlarged, partial side view of a working head and a crimping die of an alternate embodiment of the present invention.

Referring also to FIG. 4, in an alternate embodiment of the polarized or keyed die and die holder, only the lower (movable) die 54 requires keying. The lower die holder 19 does not need an integral slot, such as slot 52 shown in FIG. 3, in this configuration. In this configuration, the lower die 54 is fabricated with a lateral extension 55 having an integral groove 56. The lateral extension 55 extends across the front end of the die holder 19 of the ram 18. The groove 56 slides over the standard lower die holder 19.

In this configuration, the lower die 54 can only be installed in one direction on the lower die holder 19. Attempting to install the die 54 in the other direction would interfere with the closed end, flat face 58 of the crimp head. Further, if the user were to inadvertently attempt to install the lower die 54 in the upper die holder 32, the geometry of the crimp head in the upper die holder 32 would again prevent it from being installed into the upper die holder.

Figure 5:
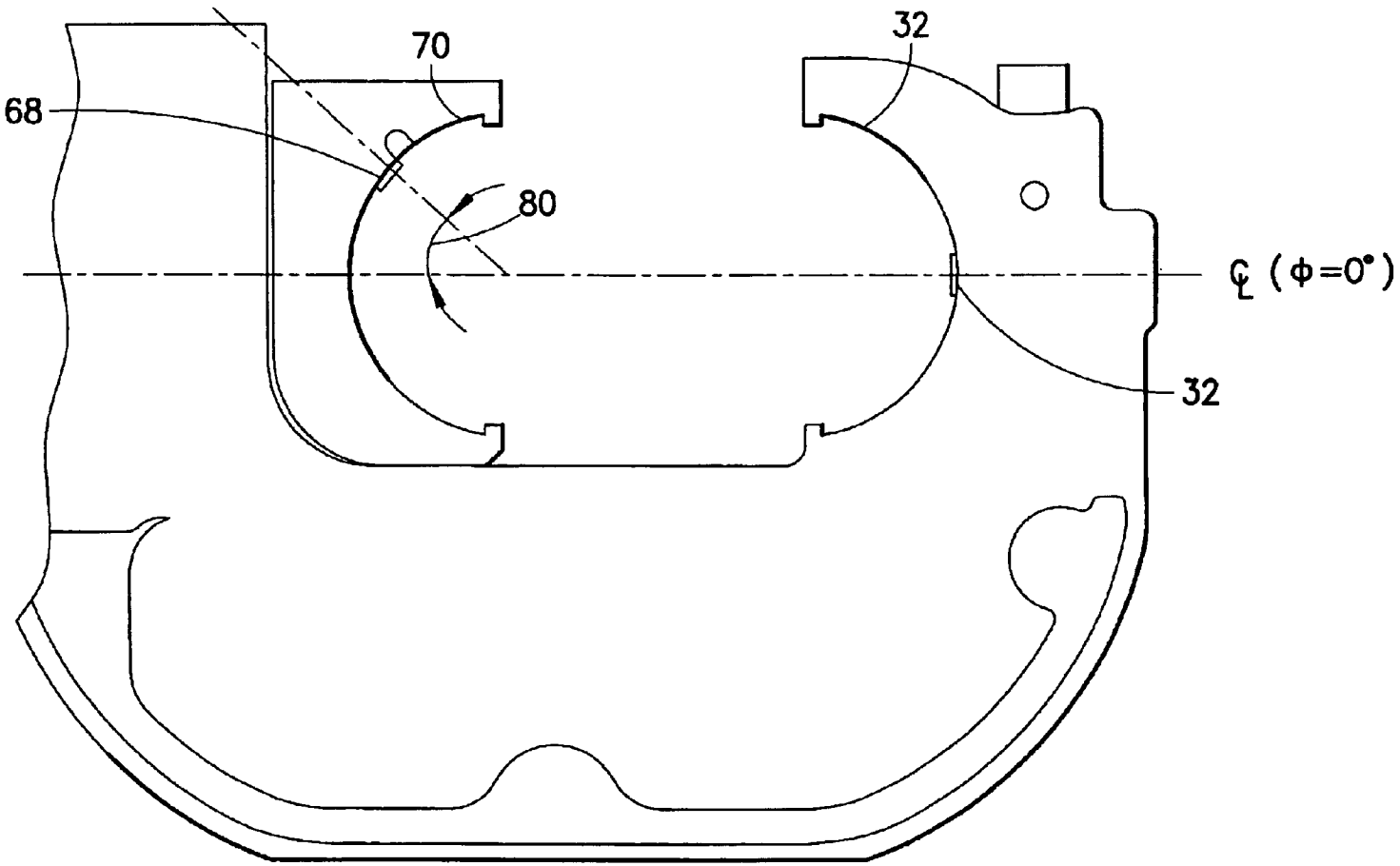
FIG. 5 is an enlarged, partial side view of a working head of an alternate embodiment of the present invention without the crimping dies.
Figure 6:
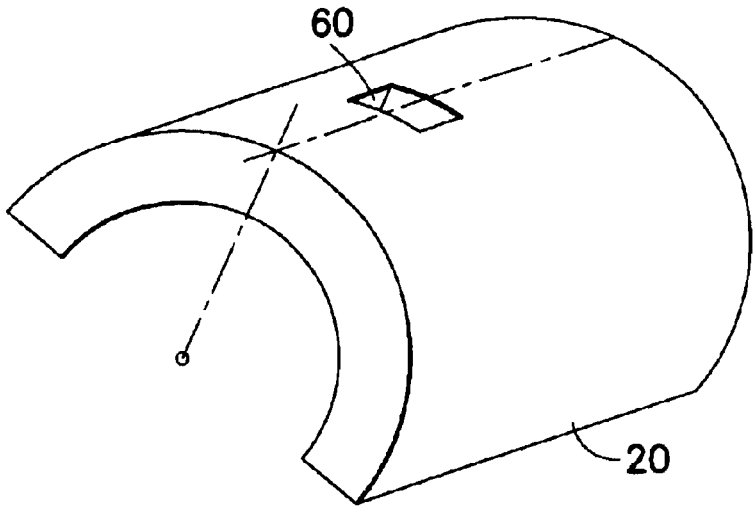
FIG. 6 is a perspective view of an upper crimp die for use with the tool shown in FIG. 5.
Figure 7:
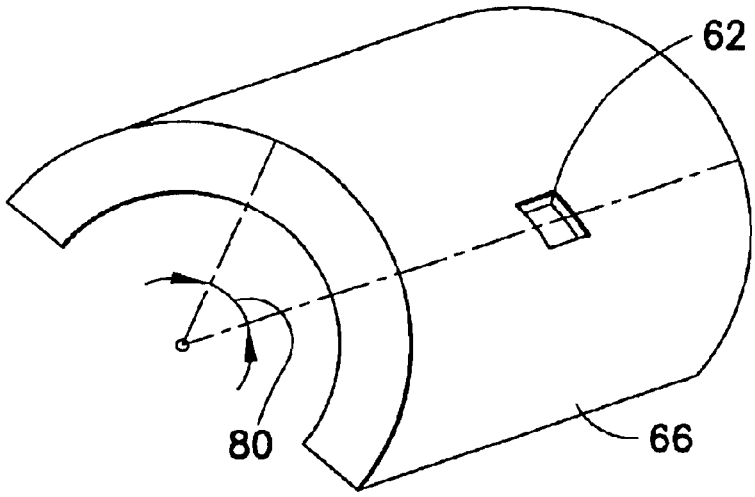
FIG. 7 is a perspective view of a lower crimp die for use with the tool shown in FIG. 5.

Referring also to FIGS. 5–7, in a third embodiment, the grooves or holes 60, 62 present in the outer radius of the crimp dies 20, 66 (used to engage with the die buttons 34, 68 in the lower and upper die holders 32, 70) could be fabricated in such a way that each crimp die would only be able to fixably engage in their respective intended upper or lower die holders. By fabricating a groove 60 on the upper fixed die 20 central to the axis/center line of the crimp die (the location of the upper die engagement button 34) and by fabricating the same type groove 62 on the lower movable die 66 at an angle 80 which is central to the location of the lower die engagement button 68 and different than the location of the upper die engagement button 32, the upper and lower dies would only be able to be fixably installed in their respective locations. Attempts to install the dies in their unintended locations would result in the inability of the die to 'snap' into place via their die engagement buttons. In an alternate embodiment, the shapes of the buttons 32, 68 and the shapes of the grooves 50, 62 could be different.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector crimping tool die set for crimping an asymmetrical electrical connector onto at least one electrical conductor, the die set comprising:

a first crimping die adapted to be removably mounted to a crimping tool; and a second crimping die adapted to be removably mounted to a movable ram of the crimping tool opposite the first die, wherein the second die comprises a generally convex shaped rear side and a generally concave shaped front side, the front side forming a crimping groove with a first center axis passing through a top and a bottom of the crimping groove that is offset from a different second center axis of the generally convex shaped rear side which passes through the rear side such that the asymmetrical electrical connector can be crimped between the first and second dies at an angle to a center axis of movement of the ram to provide a direction of crimp force substantially along or parallel to the center axis of movement of the ram.

2. An electrical connector crimping tool die set as in claim 1 wherein the first crimping die comprises a general symmetrical shaped side profile.

3. An electrical connector crimping tool die set as in claim 1 wherein the second crimping die comprises a polarizing projection extending from the rear side which is offset from a center of the second crimping die.

4. An electrical connector crimping tool die set as in claim 1 wherein the second crimping die comprises a keying projection extending from a lateral side of the second crimping die and adapted to extend to a lateral side of the ram along a front side of the ram.

5. An electrical connector crimping tool die set as in claim 1 wherein the first and second crimping dies each comprise an engagement groove adapted to receive respective movable engagement buttons of the crimping tool, and wherein the engagement groove in the first crimping die is located in a different position or has a different shape than the engagement groove in the second crimping die.

6. An electrical connector crimping tool die set as in claim 1 wherein the offset is about ⅛ inch.

7. An electrical connector crimping tool comprising:

a frame;

a drive system connected to the frame, the drive system comprising a movable ram; and an electrical connector crimping tool die set as in claim 1 connected to the frame and the ram.

8. An electrical connector crimping tool comprising:

a frame;

a drive system connected to the frame, the drive system comprising a movable ram; and connector crimping dies connected to the frame and the ram, the crimping dies comprising opposing crimp grooves, wherein a centerline between centers of the opposing crimp grooves is angled relative to a central axis of movement of the ram on the frame.

9. An electrical connector crimping tool as in claim 8 wherein a first one of the crimping dies comprises a general symmetrical shaped side profile.

10. An electrical connector crimping tool as in claim 8 wherein a second one of the crimping dies comprises a polarizing projection extending from a rear side which is offset from a center of the second crimping die.

11. An electrical connector crimping tool as in claim 8 wherein a second one of the crimping dies comprises a keying projection extending from a lateral side of the second crimping die and along a front side of the ram.

12. An electrical connector crimping tool as in claim 8 wherein the crimping dies each comprise an engagement groove which receive respective movable engagement buttons on the ram and the frame, and wherein the engagement groove in a first one of the crimping dies is located in a different position or has a different shape than the engagement groove in a second one of the crimping dies.

13. An electrical connector crimping tool as in claim 8 wherein the angle is between about 2 degrees to about 8 degrees.

14. A method of crimping an asymmetrical electrical connector comprising steps of:

connecting crimping dies to an electrical connector crimping tool; and moving a ram of the crimping tool to compress the asymmetrical electrical connector between the crimping dies, wherein one of the crimping dies connected to the ram has a crimping groove which is offset relative to an opposing crimping groove of another one of the dies connected to a frame of the crimping tool such that the opposing crimping grooves have a centerline therebetween that is angled relative to a central axis of movement of the ram on the frame such that the asymmetrical electrical connector is crimped with a direction of crimp force substantially along or parallel to the central axis of movement of the ram.

15. A method as in claim 14 wherein the step of connecting the crimping dies to the tool comprises locating a polarizing section in one of the crimping dies in a polarizing section receiving area on the ram or frame which is offset from the central axis of movement of the ram.

16. A method as in claim 14 wherein the step of connecting the crimping dies to the tool comprises locating a polarizing section in one of the crimping dies along a front side of the ram.

17. A method as in claim 14 wherein the step of connecting the crimping dies to the tool comprises positioning movable engagement projections on the ram and the frame inside receiving holes in the dies, and wherein the receiving holes are located at different positions or have different shapes on each die.

* * * * *